United States Patent [19]

Jones

[11] Patent Number: 4,985,936

[45] Date of Patent: Jan. 22, 1991

[54] ADJUSTMENT FOR GARMENT

[76] Inventor: William K. Jones, 3218 Timberview Rd., Roanoke, Va. 24019

[21] Appl. No.: 365,837

[22] Filed: Jun. 12, 1989

[51] Int. Cl.[5] ..... A41D 27/00

[52] U.S. Cl. ..... 2/269; 2/DIG. 6

[58] Field of Search ..... 2/232, 269, DIG. 6, 2/227, 243 R, 275

[56] References Cited

U.S. PATENT DOCUMENTS

| | | | |
|---|---|---|---|
| 2,153,068 | 4/1939 | Arden | 2/269 |
| 2,524,814 | 10/1959 | Leaf | 2/232 |
| 3,328,809 | 7/1967 | Payne et al. | 2/269 |
| 3,601,817 | 8/1971 | Abrams | 2/269 |
| 4,149,275 | 4/1979 | Sanchez | 2/269 |
| 4,200,938 | 5/1980 | LeTourneau | 2/269 |

OTHER PUBLICATIONS

Kallman Research Corp., "*Strapet*"; May 18, 1978.

*Primary Examiner*—Werner H. Schroeder

*Assistant Examiner*—Diana L. Biefeld

*Attorney, Agent, or Firm*—Hill, Van Santen, Steadman & Simpson

[57] ABSTRACT

There is disclosed herein an adjustment system for forming a hem on a garment, such as an inner fold of cuff on formal wear trousers. In this invention there are provided a plurality of thin vertically elongated adjuster strips secured to the inside of each trouser leg. The strips are positioned so that one strip is along each inseam and outseam and a pair of strips are adjacent each of the front and back creases. Each strip includes a fabric body for forming the loop of a hook-and-loop securement system, an adhesive coating on one side of the strip for adherence to the trouser leg, and a tab or hook material for securement to the fabric, which is positioned at one end of the strip and adjacent the bottom edge of the trouser leg. Upon folding to a predetermined length, the hook material is removably secured to the loop so as to adjust the trouser length.

5 Claims, 1 Drawing Sheet

FIG. 1
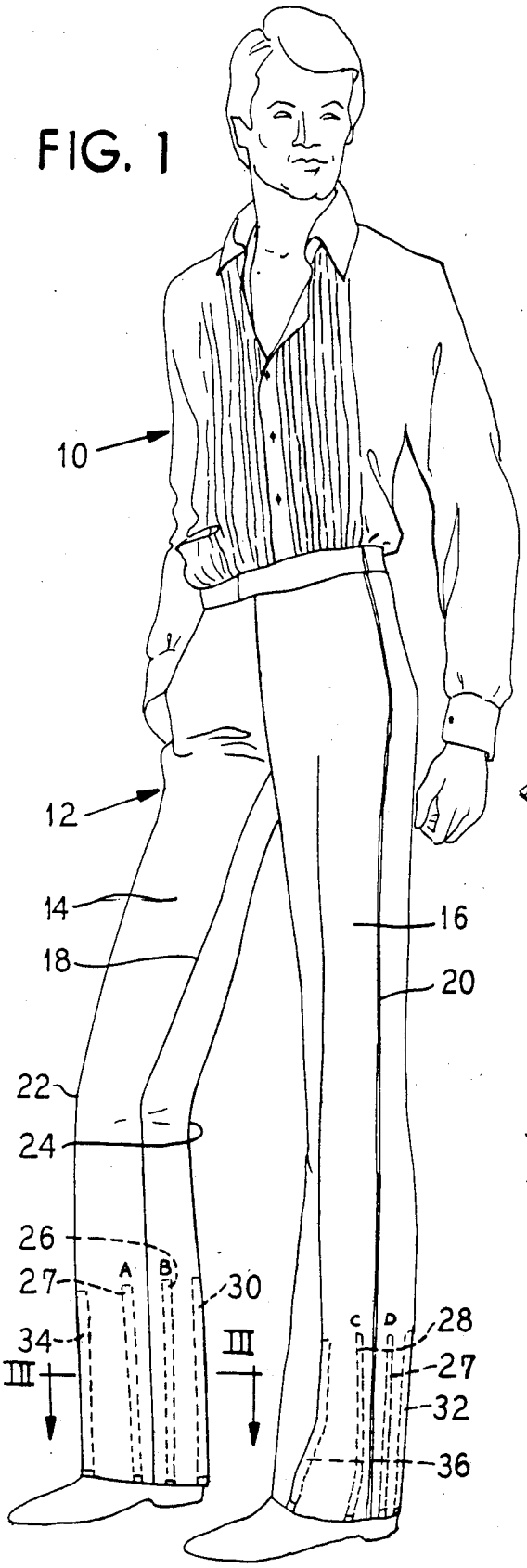
FIG. 4
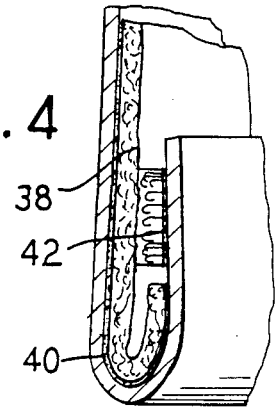
FIG. 3
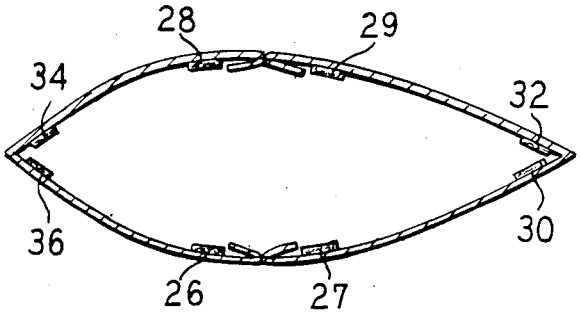
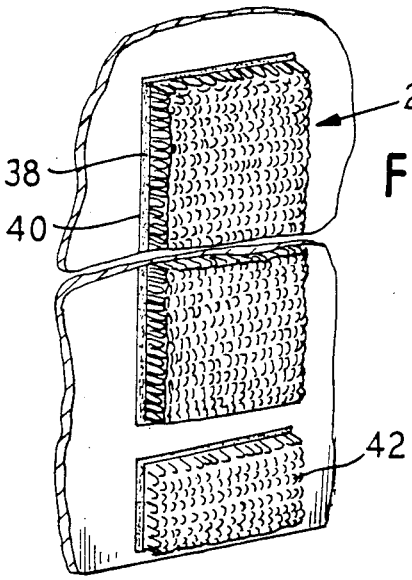
FIG. 2

ADJUSTMENT FOR GARMENT

BACKGROUND OF THE INVENTION

This invention relates to the adjustment of various lengths associated with garments, and more specifically, to the adjustment of formal wear trouser lengths.

Formal wear, such as a tuxedo, may be rented from various rental establishments. This rental requires measurement of the renting individual and then adjustment of the formal wear to those measurements.

Most frequently it is necessary to adjust the length of the trousers so as to conform with the individual's leg length. This adjustment is usually accomplished by measuring the individual's inseam length (i.e., crotch to instep distance) and then hemming the trouser at the predetermined length. Hemming is intended to refer to the cuffing, or folding back of the end, so as to reach the desired length.

Traditionally this has been done by establishing the desired length, folding the end of the trouser leg inwardly until the desired length is reached, and then cuffing or hemming the folded leg together to set the trouser length at the desired length.

The stitching operation can be time consuming, and usually each time the formal wear is re-rented, it is necessary to rip out the old stitching, readjust the length, and re-stitch or hem it. This ripping and re-stitching is usually repeated for each rental and this can be a costly and time consuming process.

A number of solutions have been proposed, such as an adhesive process, a heatseal process, and a hook-and-loop (i.e., Velcro-type) process or technique. See, for example, U.S. Pat. No. 2,153,068; 2,524,814; 3,328,809; 3,601,817; and 4,200,938. In particular, note 3,601,817, which includes a strip on a trousers' inseam which includes measurement indicia and a heat-sensitive adhesive for adherence by ironing. U.S. Pat. No. 4,200,938 discloses hook-and-loop closures which are arranged in horizontal rows that are vertically arranged and which also have an increment indicia.

None of the foregoing have been adopted on a commercial basis. The reason is believed to relate to the fact that in repeated use the adhesive can become ineffective, and it has been found that the bulk added by these heat-activated strips or Velcro pads is esthetically unacceptable.

Therefore, it is the object of this invention to provide a system or technique for the adjustment of a trouser leg length which can be used repeatedly in the formal wear environment and which does not add perceptible bulk to the trousers.

These and other objects of this invention will become apparent from the following disclosure and appended claims.

SUMMARY OF THE INVENTION

There is disclosed herein a system and technique for adjustment of the length of trouser legs of the type used in formal wear. The system employs several vertically-oriented hook-and-loop strips on the inside of each trouser leg and located at the inseam, outseam, front crease and back crease. Each strip is thin, narrow (between about one-half and one inch wide) and long (about 18 inches). Each strip has a particular heat-sensitive adhesive backing for securement to the trouser leg. The body of the strip is a particular material that forms the loop portions for securement and is thin so as to avoid the bulk appearance. The bottom of each strip has a tab (i.e., small section) of the hook material for forming the hook-and-loop connection and is stitched to the trouser leg bottom.

It has been found that in the formal wear trouser embodiment eight strips need to be used in this system to effectively form a cuff or hem. Strips are used at each seam (i.e., inseam and outseam) and at each of the front and back creases.

It has been found that the strips in this arrangement provide an effective, repeatable and commercially acceptable system.

BRIEF DESCRIPTION OF THE DRAWINGS

FIG. 1 is a perspective view of a male figure wearing trousers having the adjustment system of this invention;

. FIG. 2 is an elevational view of the hook-and-loop strip of this invention;

. FIG. 3 is a vertical sectional view taken along line III—III of FIG. 1 showing the cross-sectional structure of the strip of this invention; and FIG. 4 is a vertical view showing a strip that is folded to form a hem.

DESCRIPTION OF THE PREFERRED EMBODIMENT

Referring now to the drawings, there is shown a male FIG. 10 generally, wearing trousers 12 which have two legs 14 and 16. Each of the legs have an inseam and outseam, such as 18 and 20, and a front and a back crease such as 22 and 24. Each leg is provided with eight (8) adjustment strips. Strips, such as 26 and 27 and 28 and 29, are positioned along the inseams and outseams. Strips, such as 30 and 32, are positioned adjacent and generally parallel to the back crease such as 24. Strips 34 and 36 are positioned adjacent and generally parallel to the front crease such as 22.

The positioning of the strip is important. The front strips are to secure the front of the hem in view of the action and insertion of a user's toe. The back strips secure the back of hem relative to the action and insertion of the user.'s heel. The inseam and outseam strips keep the hem formed at the sides.

Two strips are used at each of the inseam and outseam to protect the hem in use and due to the techniques used in the trouser manufacture.

The strips are secured to the trouser by a heat-sensitive adhesive and are secured to the trouser leg by ironing or the like.

All of the strips, such as 26 in FIG. 2, are essentially identical. The strips are thin and narrow (between one-half and one inch) and elongated (about 18 inches).

Each strip has a fabric body 38, a heat-sensitive back coating 40, and a tab 42 or hook material at the strip's lower end.

The fabric 38 and tab 42 act as a hook-and-loop securement. The fabric is known as Nyloop manufactured by Lockfast Inc. of Cincinnati, Ohio. This material is generally considered to be lightweight and thus avoids esthetically unpleasing bulkiness.

The strip is coated with an adhesive that is either heat or ultrasonically sealable to the inside of the trouser leg. A particular coating is a 100 percent synthetic thermoplastic polyester resin known as Ultraseal and sold by Avanti Coatings, Inc. in Hawthorne, New Jersey. The coating is about 0.005 inch thick.

In use, the renter's inseam is measured. The trouser leg is measured to that dimension and the trouser leg is folded inwardly and upwardly until the trouser leg's inseam is the same as the measured seam. At this length each hook tab 42 on each strip is pressed or secured onto the strip's fabric body 38. When all strips are set, the trousers are pressed so as to form the creases and bottom edge.

FIG. 4 shows the formation of a cuff where the inside of a trouser leg 16 has been rolled inwardly to form a cuff and the hook tab 42 has been secured to the fabric 38. The strip has been adhered to the trouser leg by the adhesive 40.

When the trousers are returned and re-rented, the length is readjusted by separating the hook-and-loop material and re-securement at the appropriate length.

If desired, length indicating indicia may be applied to the strip so that coordination of hemming and measurement is facilitated.

This system may also be used in other applications where it is desirable to selectively set the length of a garment using a hem, for example, in a coat sleeve or a dress length.

Although the invention has been described with respect to preferred embodiments, it is not to be so limited as changes and modifications can be made which are within the full intended scope of the invention as defined by the appended claims.

I claim as my invention:

1. An adjuster system for use in combination with a trouser-like garment having a pair of legs, each leg having an inseam, an outseam, a front crease and a back crease for the adjustment of the length of each leg wherein the improvement comprises: there being provided a plurality of adjuster system, each system secured to the inner surface of a leg and having a strip-like shape for hook-and-loop securement and release said strip having a substantially continuous, elongated fabric section of the loop-type and a tab at a bottom end thereof of a hook-type fabric for cooperation with the loop-type fabric for the hook-and-loop securement, whereby said tab can be releasably secured to the elongated section for substantially continuous adjustment, each of said adjuster systems oriented generally parallel to the length of the leg and affixed adjacent the bottom end thereof, with the hook-type tab adjacent the bottom end and between the bottom end and the loop-type fabric section with an adjuster system adjacent each of said inseam, outseam, front crease and back crease, whereby the length of the trouser leg can be selectively and continuously adjusted by causing the hood-type tab to engage the loop fabric along the length thereof for stitch-free length adjustment and ready and imperceptible cleaning.

2. A combination as in claim 1, wherein four pairs of adjuster strips are provided, one pair adjacent each of the inseam, outseam, front crease and back crease.

3. An adjuster as in claim 2, wherein each of the inseam, outseam, front crease and back crease is positioned between the members of an adjacent pair of adjusters.

4. An adjuster system for use in combination with a garment to form a hem on an edge thereof, there being provided a plurality of adjuster systems, each system secured to the inner surface of a leg and having a strip-like shape for hook-and-loop securement and release, said strip having a substantially continuous, elongated fabric section of the loop-type, and a tab at an end thereof of a hook-type fabric for cooperation with the loop-type fabric for the hook-and-look securement, whereby said tab can be releasably secured to the elongated section for substantially continuous adjustment, each of said adjuster systems oriented generally tansverse to the garment edge and affixed adjacent the edge thereof, with the hook-type tab adjacent the edge and between the edge and the loop-type fabric with an adjuster system, whereby a hem can be selectively and continuously formed by causing the hook-type tab to engage the loop fabric along the length thereof for stich-free adjustment and readjustment and for ready and imperceptible cleaning.

5. An adjuster system for use in continuous but selectively adjusting the length of a garment by forming a hem along an edge of a garment, by application of the system transverse to a garment along the edge to be adjusted comprising:

a thin and elongated strip-like body of substantially continuous loop-type fabric of the hook-and-loop securement type to be adhered to the garment; and a tab of hook-type fabric of the hook-and-loop securement type constructed to be positioned adjacent the elongated body and between the body and garment end for securement to the body;

whereby the length of the garment can be selectively but continuously adjusted.

* * * * *

UNITED STATES PATENT AND TRADEMARK OFFICE

CERTIFICATE OF CORRECTION

PATENT NO. : 4,985,936

DATED : January 22, 1991

INVENTOR(S) : William K. Jones

It is certified that error appears in the above—identified patent and that said Letters Patent is hereby corrected as shown below:

Abstract, second line, change "of" to --or--;

Column 2, line 29, change "FIG." to --figure--;

Column 3, line 25, change "system" to --systems--;

Column 4, line 3, change "hood-type" to --hook-type--;

Column 4, line 25, change "tansverse" to --transverse--; and

Column 4, line 32, change "stich-free" to --stitch-free--.

Signed and Sealed this

Twenty-first Day of July, 1992

*Attest:*

DOUGLAS B. COMER

*Attesting Officer*

*Acting Commissioner of Patents and Trademarks*